US006604836B2

(12) United States Patent
Carlucci et al.

(10) Patent No.: US 6,604,836 B2
(45) Date of Patent: Aug. 12, 2003

(54) VARIABLE LIGHTED MAKE-UP MIRROR

(75) Inventors: Vito J. Carlucci, Stratford, CT (US); Richard Neil Tobin, Stamford, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 09/965,649

(22) Filed: Sep. 27, 2001

(65) Prior Publication Data

US 2003/0058639 A1 Mar. 27, 2003

(51) Int. Cl.[7] ..... F21V 33/00

(52) U.S. Cl. ..... 362/140; 362/135; 362/137; 362/142; 362/144; 362/802

(58) Field of Search ..... 362/129, 135, 362/136, 137, 140, 141, 142, 143, 144, 231, 236; 315/216, 217, 312, 315, 317, 320

(56) References Cited

U.S. PATENT DOCUMENTS

| | | | | | |
|---|---|---|---|---|---|
| 3,381,120 | A | | 4/1968 | Fleisher et al. | 240/4.2 |
| D223,885 | S | | 6/1972 | Bransky | D86/10 |
| 3,757,103 | A | | 9/1973 | Walter | 240/4.2 |
| 3,794,828 | A | | 2/1974 | Arpino | 240/4.2 |
| D235,689 | S | | 7/1975 | Benty et al. | D86/10 H |
| D261,817 | S | | 11/1981 | Kretschmer | D28/67 |
| 5,207,501 | A | * | 5/1993 | Sakuma et al. | 362/135 |
| 5,392,162 | A | | 2/1995 | Glucksman | 359/872 |
| 5,725,295 | A | | 3/1998 | Moncourtois et al. | 362/32 |
| 5,997,149 | A | * | 12/1999 | Chu | 362/142 |
| 6,386,741 | B1 | * | 5/2002 | Jones et al. | 174/257 |

* cited by examiner

*Primary Examiner*—Thomas M. Sember
*Assistant Examiner*—John Amarantides
(74) *Attorney, Agent, or Firm*—Ohlandt, Greeley, Ruggiero & Perle, LLP

(57) ABSTRACT

An illuminated mirror is provided that has a first light source of a first color and a second light source of a second color, a reflective surface adapted to be illuminated by the light sources, and a switch. The switch selectively controls the flow of power to the first light source, the second light source, or both light sources. Controlling the flow of power to the first light source simulates home light. Controlling the flow of power to the second light source simulates office light. Controlling the flow of power to both light sources simulates Day light.

20 Claims, 6 Drawing Sheets

VARIABLE LIGHTED MAKE-UP MIRROR

BACKGROUND OF THE INVENTION

1. Field of the Invention

The present invention relates to an illuminated mirror for use in applying make-up. Moreover, the present invention relates to a variable lighted make-up mirror. The mirror illuminates the face of the user with various light settings experienced by the user during the course of a day.

2. Description of the Prior Art

It is generally known in the art to provide mirror illuminated by fluorescent bulbs and containing various light filters, which permits the mirror to illuminate the face of the user with various light settings. However, such devices require mechanical means such as levers, switches, gears and the like to maneuver the various light filters into position between the fluorescent light source and the user. Such mechanical means add expense, complexity and lower durability to the device.

It is also known in the art to provide mirror illuminated by incandescent bulbs. For example, U.S. Pat. No. 3,794,828 to Aprino provides a lighted mirror having a plurality of incandescent lamps. Some of the lamps provide red light and other lamps provide white light. The lamps providing red light are connected in parallel to one another. Similarly, the lamps providing white light are connected in parallel to one another. The lamps proving red light are connected in series to the lamps providing white light across a source of 100-volt power. The red lamps are connected to an electronic control circuit for varying the intensity of light emitted from the red lamps. However, such lighted mirrors require means for varying the intensity of light emitted, which adds complexity and expense to the mirror.

SUMMARY OF THE INVENTION

It is an object of the present invention to provide a mirror for use in applying make-up.

It is another object of the present invention to provide such a mirror that is illuminated by a plurality of incandescent light sources.

It is a further object of the present invention to provide such a mirror in which some of the light sources are of a first color, some of the light sources are of a second color, and a selector selectively and fully powers various combinations of the light sources to simulate various light settings.

These and other objects of the present invention are provided by an illuminated mirror having a first light source of a first color and a second light source of a second color, a reflective surface, and a switch. The reflective surface is adapted to be illuminated by the light sources in various light settings. The switch selectively powers either the first light source, the second light source, or to both light sources. Preferably, powering the first light source simulates home light, powering the second light source simulates office light, and day light is simulated by powering both light sources.

The present invention also provides a method of illuminating a mirror to one of a number of different light settings, such as a day light setting, an office light setting, and a home light setting. The light settings are selected via a selector disposed on the mirror. The mirror is adapted to be illuminated by a first plurality of incandescent light bulbs and a second plurality of incandescent light bulbs. Selecting the home light setting powers the first plurality of incandescent light bulbs. Selecting the office light setting powers the second plurality of incandescent light bulbs. Selecting the daylight setting powers both the first and second pluralities of incandescent light bulbs.

DESCRIPTION OF THE FIGURES

FIG. 2 is an enlargement of the rim of the mirror of FIG. 1;

FIG. 3 is an enlargement of the upper swivel connection of FIG. 1;

DETAIL DESCRIPTION OF THE INVENTION

Figure 1:
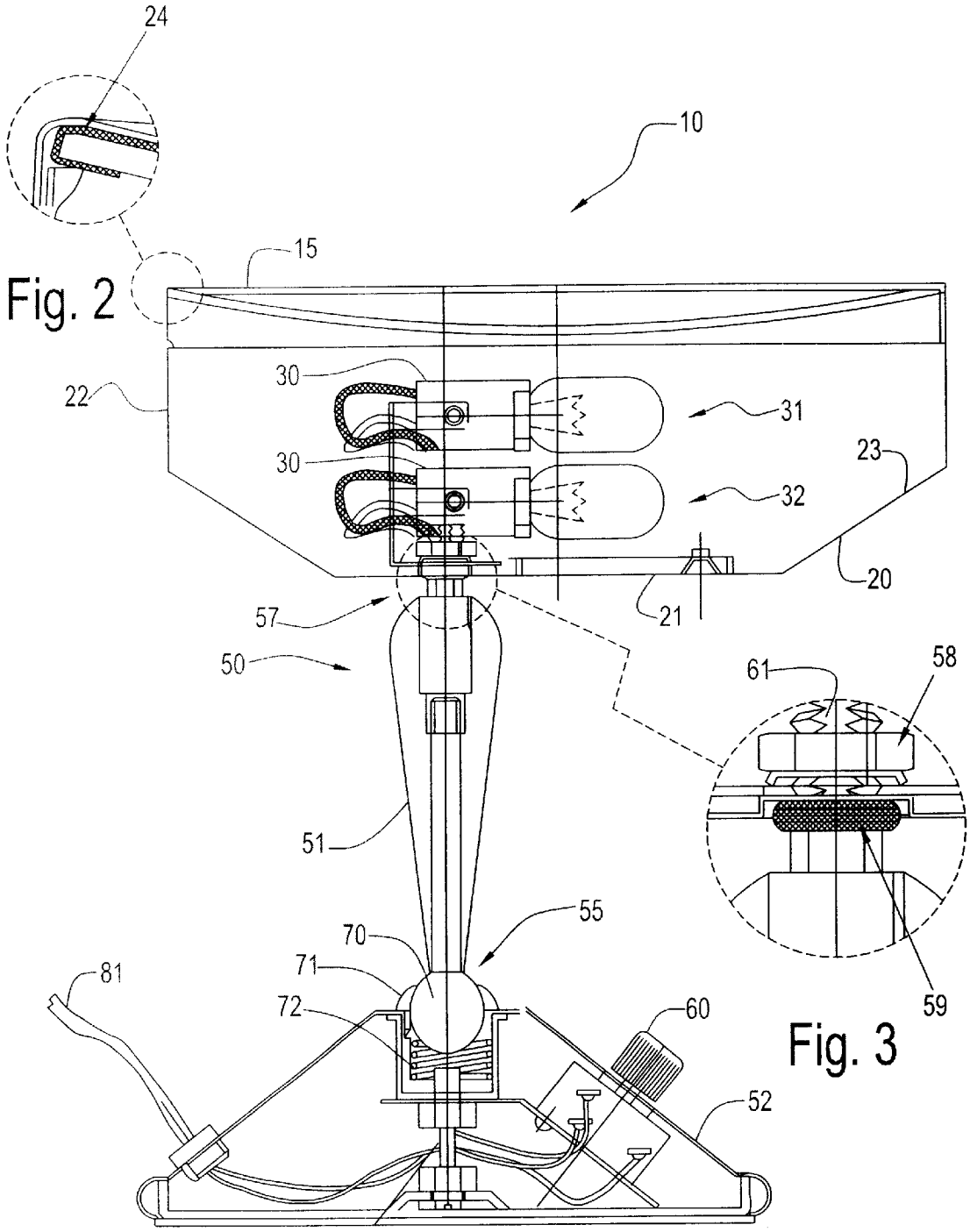
FIG. 1 is a cross section of a first embodiment of the mirror of present invention.

Referring to the figures and particularly to FIG. 1, a lighted mirror designated by reference numeral 10 is shown. Mirror 10 has a reflective surface 15, a housing 20, and a stand 50. Reflective surface 15 is adapted to be connected to housing 20, which is adapted to be connected to stand 50.

Housing 20 has a first incandescent light source 31 and a second incandescent light source 32, each operatively connected to a power source 80. Preferably, power source 80 is a standard residential 120-volt power source. The connection of first incandescent light source 31, second incandescent light source 32, and power source 80 is preferably through a first switch 60 and a power cord 81.

Referring to FIG. 2, reflective surface 15 is a circular surface and is connected to housing 20 by a sleeve 24. Housing 20 has an access door 21 removably sealed to the housing. Access door 21 permits access to first and second light sources 31, 32 to enable replacement of the light sources as needed. First and second light sources 31, 32 are preferably operatively connected to holders 30. Holders 30 are electrically connected to power source 80 through first switch 60 and power cord 81. Optionally, housing 20 has a reflective coating 23 disposed in the inside of the housing to internally reflect and magnify light from first and second light sources 31, 32.

Stand 50 includes a mirror stem 51 and a base 52. Preferably, base 52 is connected to stem 51 by a lower swivel connection 55 and stem 51 is connected to housing 20 by an upper swivel connection 57. Thus, the user adjusts housing 20 by swivel connections 55, 57 to present reflective surface 15 at an optimal position.

Lower swivel connection 55 includes a swivel ball 70 disposed on the lower end of stem 51. Ball 70 is retained in base 52 by a collar 71 and a spring 72. In its normal position, ball 70 is biased against collar 71 by spring 72. In order to swivel lower swivel connection 55, the user depresses stem 51, which causes ball 70 to overcome the biasing force of spring 72, enabling the ball to swivel freely with respect to collar 71. Once adjusted to the desired position, the user releases stem 51. Thus, spring 72 biases ball 70 against collar 71, locking stem 51 in place.

Upper swivel connection 57, shown in FIG. 3, has a hex nut 58 and a washer 59, which attaches mirror housing 20 to stem 51. Hex nut 58 is preferably threaded onto a threaded tubing 61. Threaded tubing 61 preferably terminates in a drilled and tapped block (not shown) that is set in a pocket (not shown) of stem 51 and retained such that it can swivel in at least one axis approximately 90 degrees to enable mirror 10 to be tilted in one or more directions.

In a preferred embodiment, first incandescent light source 31 is at least one incandescent bulb and second incandescent light source 32 is at least one incandescent bulb. Light emitted from first and second light sources 31, 32 are radiated from housing 20 through rim 22. The user changes the color of the light radiated by mirror 10 by selectively energizing various combinations of light sources 31, 32 by first switch 60.

Source 31 radiates light of a first color. Source 32 radiates light of a second color. In one embodiment, first light source 31 radiates white light, and second light source 32 radiates blue light. Preferably, second light source 32 radiates blue light by radiating light through a blue filter. The blue filter is preferably painted or in the glass directly on second light source 32.

Mirror 10 is adapted to radiate light of different colors through rim 22 in order to approximate the various light settings present during the course of the day. The light setting of mirror 10 is adjusted by first switch 60. First switch 60 controls the flow of power from power source 80 to first light source 31 and/or second light source 32. For instance, the user is able to adjust the light radiated by mirror 10 to approximate: (1) office light in which power flows only to second light source 32; (2) home light in which power flows only to first light source 31; (3) day light in which power flows to both first and second light sources 31, 32; or (4) evening light in which partial power flows only to first light source 31.

Figure 4:
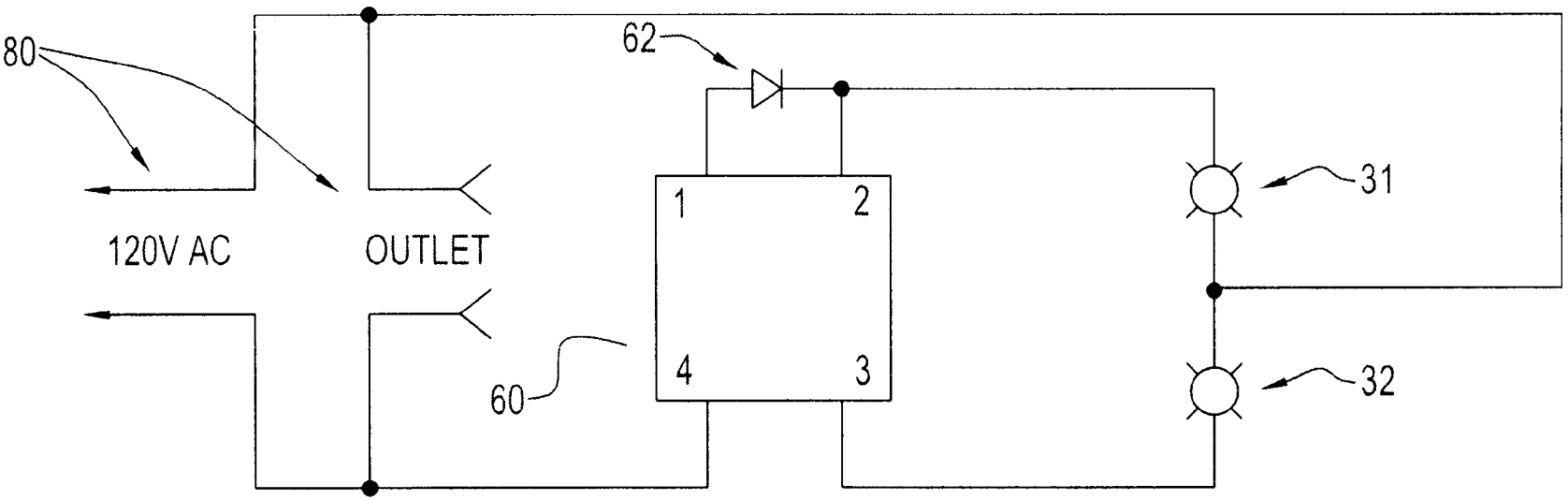
FIG. 4 is a first electrical schematic for the mirror of FIG. 1.

Referring to FIG. 4, first switch 60 is operatively connectable to four nodes, namely node 1, node 2, node 3 and node 4. More specifically, node 1 is operatively connected to first light source 31 through rectifier 62; node 2 is operatively connected to first light source 31, but not through rectifier 62; node 3 is operatively connected to second light source 32; and node 4 is operatively connected to power source 80. First switch 60 has an off position, an office light position, a home light position, an evening light position, and a day light position. Preferably, first switch 60 is a rotary switch.

Thus, first switch 60 does not operatively connect node 4 to either light source 31, 32 in the off position. In the "office light" position, first switch 60 operatively connects node 4 to node 3 to power second light source 32. In the "home light" position, first switch 60 operatively connects node 4 to node 2 to power first light source 31. In the "evening light" position, first switch 60 operatively connects node 4 to node 1 to power first light source 31 through rectifier 62. Rectifier 62 is adapted to adjust the amount of voltage provided to power first light source 31. Accordingly, rectifier 62 only partially powers first light source 31. In a preferred embodiment, rectifier 62 is a diode. In the "day light" position, first switch 60 operatively connects node 4 to node 2 and to node 3 and thus powers both first light source 31 and second light source 32.

Figure 5:
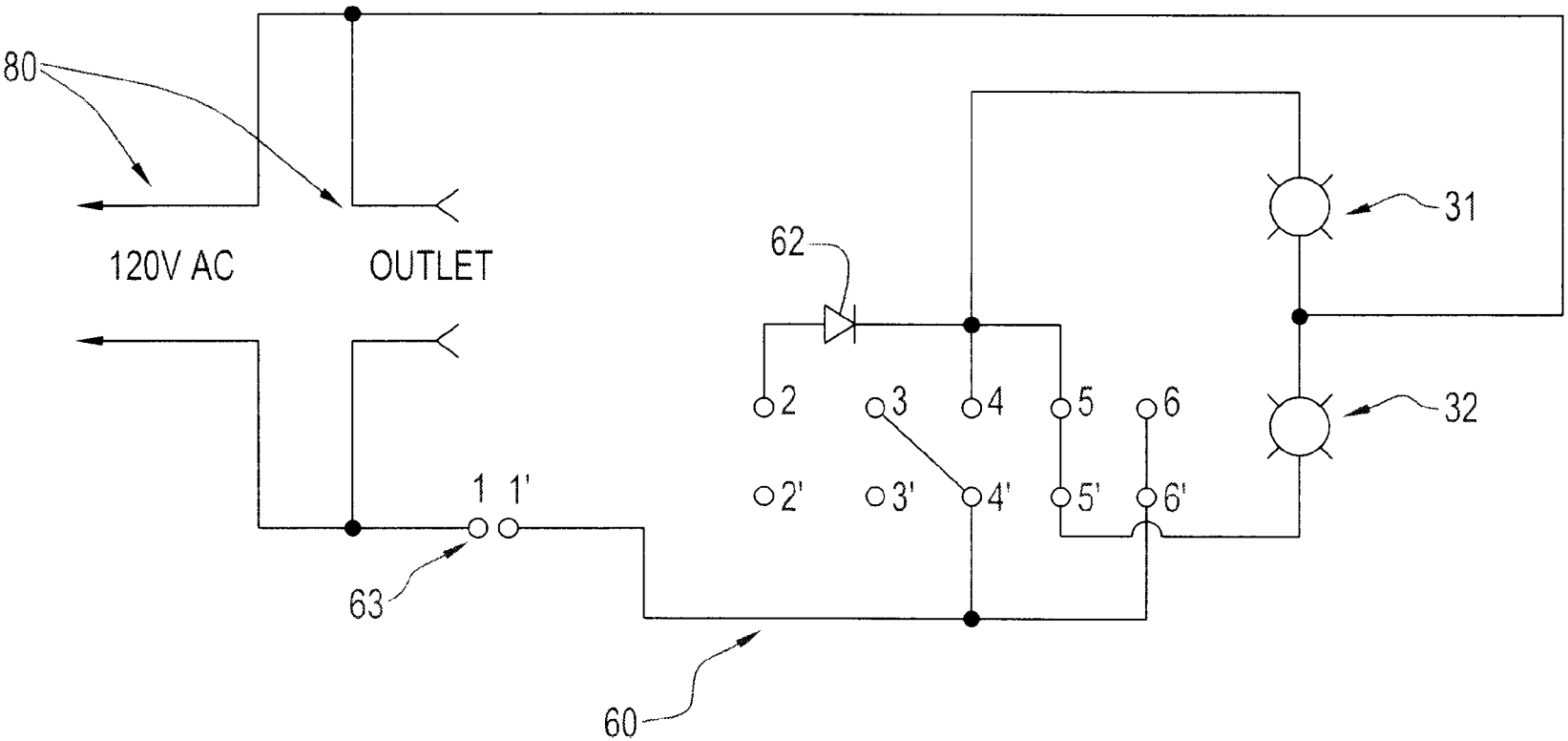
FIG. 5 is a second electrical schematic for the mirror of FIG. 1.

In an alternate embodiment shown in FIG. 5, first switch 60 is preferably operatively connectable to a second switch 63 and ten nodes, namely node 2, node 2', node 3, node 3', node 4, node 4', node 5, node 5', node 6, and node 6'. When second switch 63 is in an "off" position, node 1 preferably is not connected to node 1' and thus, first switch 60 is not operable. When second switch 63 is in an "on" position, node 1 is connected to node 1' and first switch 60 is operatively connected to light sources 31 and 32. First switch 60 preferably has an "evening light" position, a "home light" position, an "office light" position and a "day light" position. Preferably, first switch 60 is a slide switch.

Power source 80 is operatively connected to node 1, which is operatively connected to node 1' via second switch 63. Nodes 1', 3, 4', 6 and 6' are preferably operatively connected to one another. Node 2 is operatively connected to first light source 31 through rectifier 62. Node 4 and node 5 are also operatively connected to first light source 31, however not through rectifier 62. Node 5' is operatively connected to second light source 32.

In the "evening light" position, preferably first switch 60 operatively connects node 2 to node 3 and node 2' to node 3', and enables first light source 31 to be powered through rectifier 62. Rectifier 62 is preferably adapted to adjust the amount of voltage provided to power first light source 31. Accordingly, rectifier 62 only partially powers first light source 31. In the "home light" position, preferably first switch 60 operatively connects node 3 to node 4 and node 3' to node 4', and enables first light source 31 to be fully powered absent the dampening effect of rectifier 62. In the "office light" position, preferably first switch 60 operatively connects node 4 to node 5 and node 4' to node 5', and enables second light source 32 to be fully powered. In the "day light" position, first switch 60 operatively connects node 5 to node 6 and node 5' to node 6', and enables both first light source 31 and second light source 32 to be fully powered.

Figure 6:
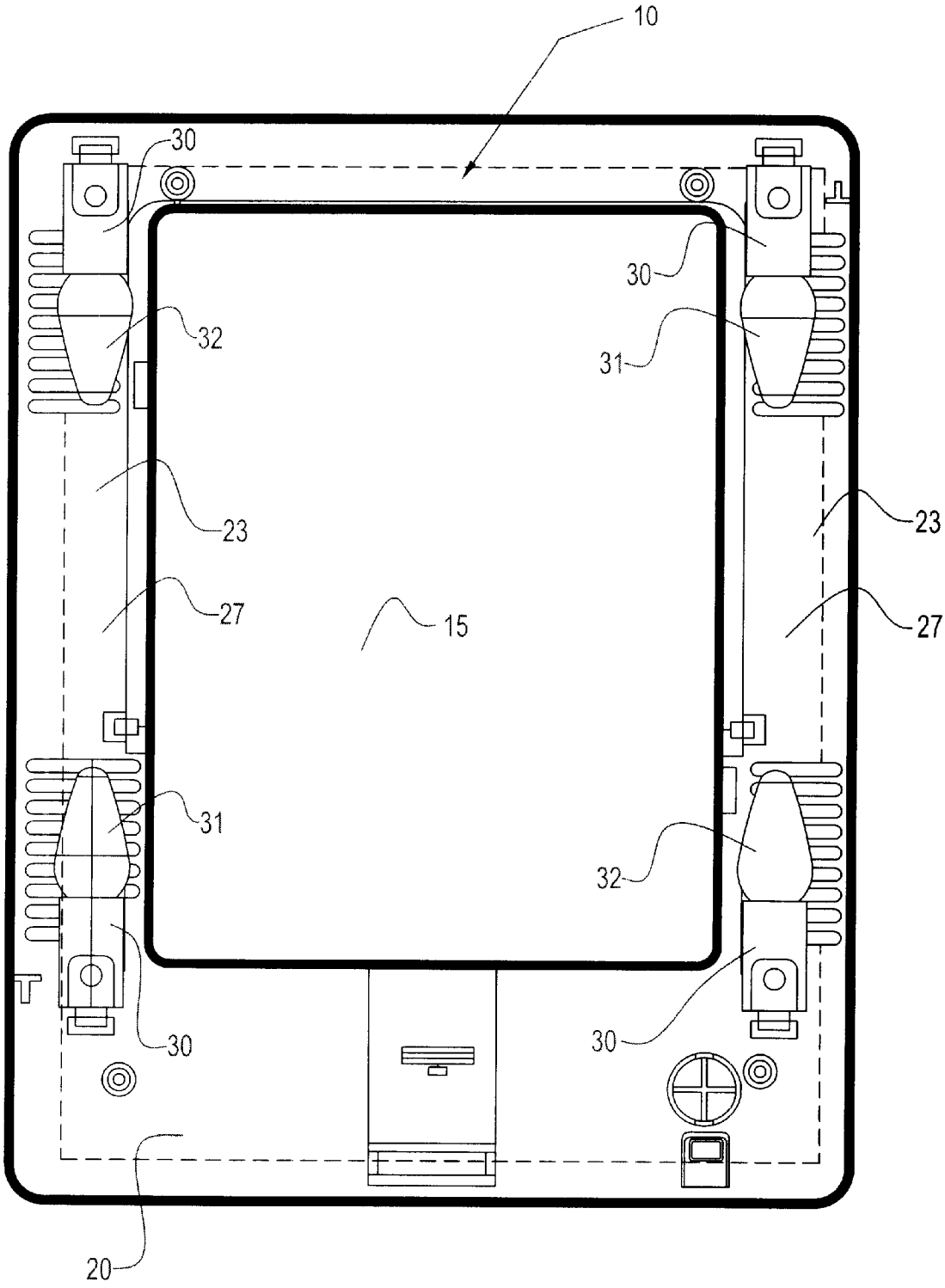
FIG. 6 is a cross section of a second embodiment of the mirror of the present invention.

An alternate embodiment of mirror 10 is shown in FIG. 6 as mirror 10'. Mirror 10' has a rectangular reflective surface 15, a housing 20, and a stand (not shown). Reflective surface 15 is adapted to be connected to housing 20, which is adapted to be connected to the stand.

Housing 20 has two first incandescent light sources 31 and two second incandescent light sources 32 operatively connected to power source 80. Light emitted from first and second light sources 31, 32 is radiated from housing 20 through an elongated light diffuser 27. The user changes the color of the light radiated by mirror 10' by selectively energizing various combinations of light sources 31, 32 via first switch 60.

Preferably, first and second light sources 31, 32 are operatively connected to holders 30. Holders 30 are electrically connected to power source 80 through first switch 60 and power cord 81. As with the embodiment of FIG. 1, housing 20 optionally includes a reflective coating 23 disposed in the housing to internally reflect and magnify light from first and second light sources 31, 32.

As described above, sources 31 radiate light of a first color, and light sources 32 radiate light of a second color. In a preferred embodiment, first light sources 31 radiate white light and second light sources 32 radiate blue light.

Figure 7:
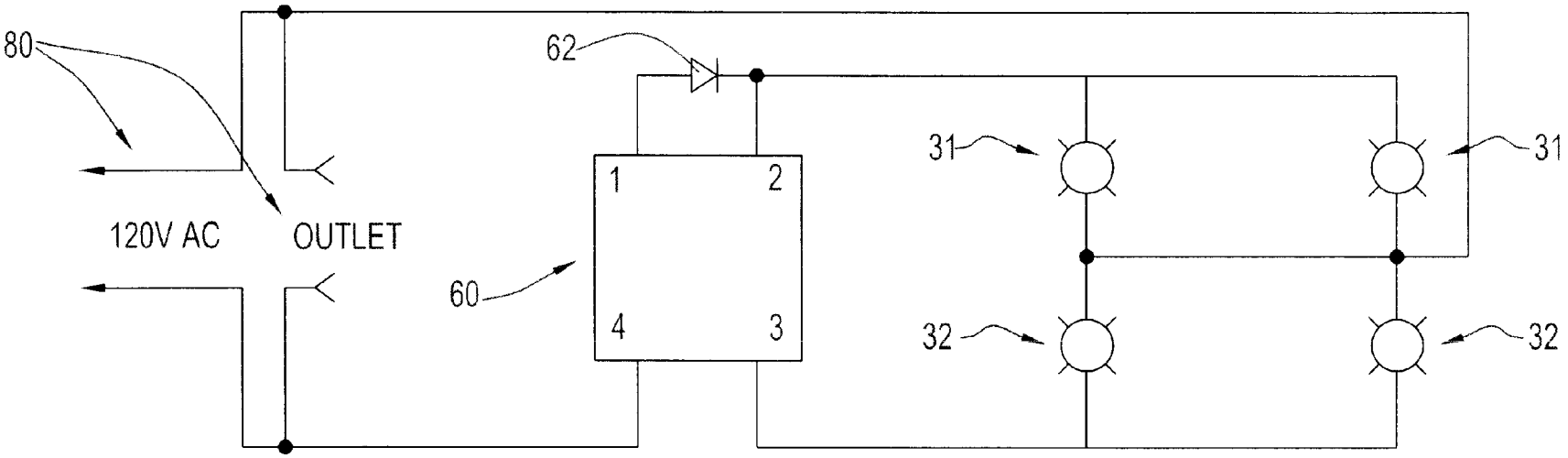
FIG. 7 is a first electrical schematic for the mirror of FIG. 6.

Referring to FIG. 7, first switch 60 is operatively connectable to four nodes, namely node 1, node 2, node 3 and node 4. More specifically, node 1 is operatively connected to first light sources 31 through rectifier 62; node 2 is operatively connected to first light sources 31, but not through rectifier 62; node 3 is operatively connected to second light sources 32; and node 4 is operatively connected to power source 80. First switch 60 has an off position, an office light position, a home light position, an evening light position, and a day light position. Preferably, first switch 60 is a rotary switch.

Thus, first switch 60 does not operatively connect node 4 to either light sources 31, 32 in the off position. In the "office light" position, first switch 60 operatively connects node 4 to node 3 to power second light sources 32. In the "home light" position, first switch 60 operatively connects node 4 to node 2 to power first light sources 31. In the "evening light" position, first switch 60 operatively connects node 4 to node 1 to power first light sources 31 through rectifier 62. Rectifier 62 is adapted to adjust the amount of voltage provided to power first light sources 31. Accordingly, rectifier 62 only partially powers first light sources 31. In a preferred embodiment, rectifier 62 is a diode. In the "day light" position, first switch 60 operatively connects node 4 to node 2 and to node 3 and thus powers both first light sources 31 and second light sources 32.

Figure 8:
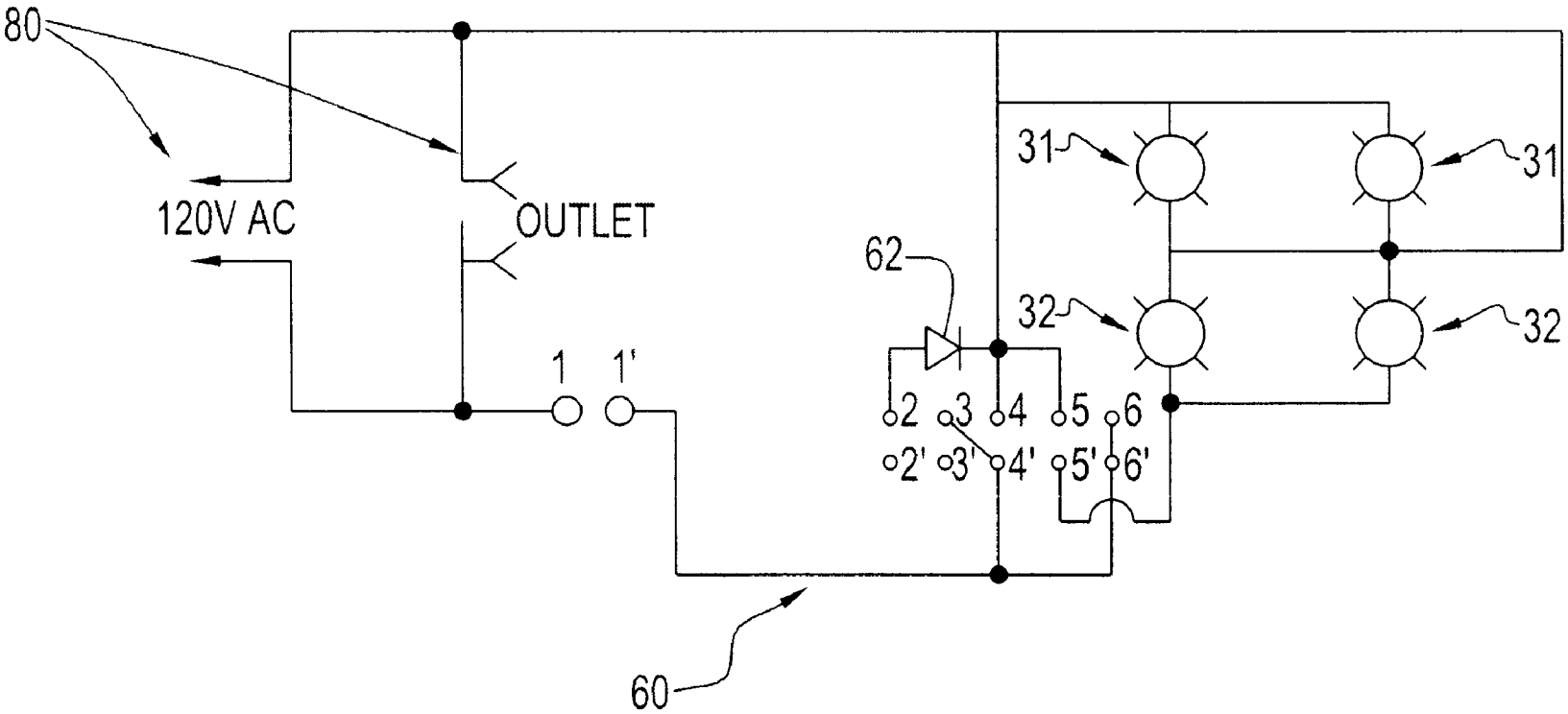
FIG. 8 is a second electrical schematic for the mirror of FIG. 6.

Similar to the embodiment of FIG. 5, the embodiment shown in FIG. 8 has first switch 60 preferably operatively connectable to a second switch 63 and ten nodes, namely node 2, node 2', node 3, node 3', node 4, node 4', node 5, node 5', node 6, and node 6'. When second switch 63 is in an "off" position, node 1 preferably is not connected to node 1' and thus, first switch 60 is not operable. When second switch 63 is in an "on" position, node 1 is connected to node 1' and first switch 60 is operatively connected to light sources 31 and 32. First switch 60 preferably has an "evening light" position, a "home light" position, an "office light" position and a "day light" position. Preferably, first switch 60 is a slide switch.

Power source 80 is operatively connected to node 1, which is operatively connected to node 1' via second switch 63. Nodes 1', 3, 4', 6 and 6' are preferably operatively connected to one another. Node 2 is operatively connected to first light sources 31 through rectifier 62. Node 4 and node 5 are also operatively connected to first light sources 31, however not through rectifier 62. Node 5' is operatively connected to second light sources 32.

In the "evening light" position, preferably first switch 60 operatively connects node 2 to node 3 and node 2' to node 3', and enables first light sources 31 to be powered through rectifier 62. Rectifier 62 is preferably adapted to adjust the amount of voltage provided to power first light sources 31. Accordingly, rectifier 62 only partially powers first light sources 31. In the "home light" position, preferably first switch 60 operatively connects node 3 to node 4 and node 3' to node 4', and enables first light sources 31 to be fully powered absent the dampening effect of rectifier 62. In the "office light" position, preferably first switch 60 operatively connects node 4 to node 5 and node 4' to node 5', and enables second light sources 32 to be fully powered. In the "day light" position, first switch 60 operatively connects node 5 to node 6 and node 5' to node 6', and enables both first light sources 31 and second light sources 32 to be fully powered.

It should be understood from the foregoing description that any shape mirror having one or more first light sources and one or more second light sources are included within the scope of the present invention. It should also be understood the present invention function with any combination of first and second light sources, such as, but not limited to, three first light sources and two second light sources. Moreover, it should be understood that the foregoing description is only illustrative of the present invention. Various alternatives and modifications can be made by those skilled in the art without departing from the invention. Accordingly, the present invention is intended to embrace all such alternatives, modifications and variances that fall within the scope of the appended claims.

What is claimed is:

1. A variable lighted mirror, comprising:

a first light source of a first color;

a second light source of a second color;

a reflective surface adapted to illuminate the face of a user with various light settings experienced by the user during the course of a day; and a switch selectively, operatively connectable to two or more nodes for controlling the flow of power to either said first light source, said second light source, or both said first and second light sources.

2. The illuminated mirror of claim 1, wherein said first light source comprises at least one incandescent light bulb, and wherein said second light comprises at least one incandescent light bulb.

3. The illuminated mirror of claim 1, wherein said first color is white light, and wherein said second color is blue light.

4. The illuminated mirror of claim 3, wherein said second light source comprises at least one incandescent light bulb having a surface painted blue so as to filter light emitted therefrom.

5. The illuminated mirror of claim 1, wherein said switch is a multiple position switch selected from the group consisting of a rotary dial switch and a linear slide switch.

6. The illuminated mirror of claim 1, wherein selectively controlling the flow of power to said second light source illuminates said reflective surface so as to simulate office light.

7. The illuminated mirror of claim 1, wherein selectively controlling the flow of power to said first light source and said second light source illuminates said reflective surface so as to simulate day light.

8. The illuminated mirror of claim 1, further comprising a rectifier and wherein said switching means is further adapted to selectively control the flow of power to said first light source through said rectifier such that said first light source is partially powered.

9. The illuminated mirror of claim 1, wherein selectively controlling the flow of power to said first light source illuminates said reflective surface so as to simulate home light.

10. The illuminated mirror of claim 9, wherein selectively controlling the flow of power to said first light source through said rectifier illuminates said reflective surface so as to simulate evening light.

11. An illuminated mirror, comprising:

a first plurality of incandescent lights;

a second plurality of incandescent lights;

a mirror adapted to illuminate the face of a user with various light settings experienced by the user during the course of a day; and a switch selectively, operatively connectable to two or more nodes for selectively controlling the flow of power to either said first plurality of incandescent lights, to said second plurality of incandescent lights, or to both said first and second pluralities of incandescent lights.

12. The illuminated mirror of claim 11, wherein said first plurality of incandescent light bulbs radiate white light, and wherein said second plurality of incandescent light bulbs radiate blue light.

13. The illuminated mirror of claim 11, wherein said switch is a multiple position switch selected from the group consisting of a rotary dial switch and a linear slide switch.

14. The illuminated mirror of claim 11, further comprising a rectifier, and wherein said switch is further adapted to selectively controlling the flow of power to said first plurality of incandescent light bulbs through said rectifier such that said first plurality of incandescent light bulbs is partially powered.

15. The illuminated mirror of claim 14, wherein controlling the flow of power to said first plurality of incandescent light bulbs through said rectifier simulates evening light.

16. The illuminated mirror of claim 11, wherein controlling the flow of power to said first light source simulates home light, controlling the flow of power to said second light source simulates office light, and controlling the flow of power to said first light source and said second light source simulates day light.

17. A method of illuminating a mirror adapted to be illuminated by a first plurality of incandescent lights and a second plurality of incandescent lights to one of a number of different light settings, comprising the steps of:

providing a first plurality of incandescent lights;

a second plurality of incandescent lights;

a mirror adapted to illuminate the face of a user with various light settings experienced by the user during the course of a day; and a switch selectively, operatively connectable to one or more nodes for selectively controlling the flow of power to either said first plurality of incandescent lights, to said second plurality of incandescent lights, or to both said first and second pluralities of incandescent lights;

controlling the flow of power to the first plurality of incandescent lights to illuminate the mirror in a first one of the different light settings;

controlling the flow of power to the second plurality of incandescent lights to illuminate the mirror in a second one of the different light settings; and controlling the flow of power to both the first and second pluralities of incandescent lights to illuminate the mirror a third one of the different light settings.

18. The method of illuminating a mirror of claim 17, wherein the first plurality of incandescent light bulbs radiate white light, and the second plurality of incandescent light bulbs radiate blue light.

19. The method of illuminating a mirror of claim 17, wherein the first one of the different light settings simulates home light, the second one of the different light settings simulates office light, and the third one of the different light settings simulates day light.

20. The method of illuminating a mirror of claim 17, further comprising:

controlling the flow of power to the first plurality of incandescent light bulbs through a rectifier in a fourth one of the different light setting to partially power the first plurality of incandescent light bulbs and simulate evening light.

* * * * *

UNITED STATES PATENT AND TRADEMARK OFFICE

CERTIFICATE OF CORRECTION

PATENT NO. : 6,604,836 B2 
DATED : August 12, 2003
INVENTOR(S) : Vito L. Carlucci and Richard Neil Tobin It is certified that error appears in the above-identified patent and that said Letters Patent is hereby corrected as shown below:

Column 6,
Line 5, "a reflective surface adapted to illuminate the face" should read -- a reflective surface being adapted to illuminate a face. --
Line 8, "a switch selectively, operatively connectable to two or more nodes for controlling the flow of power to either said first light source, said second light source, or both said first and second light sources" should read -- a control switch for selectively connecting two or more nodes to adjustably and directly control the flow of power to said first light source, said second light source, or said first and second light sources. --
Line 50, "a mirror adapted to illuminate" should read -- a mirror being adapted to illuminate. --
Line 53, "a switch selectively, operatively connectable to two or more nodes for selectively controlling the flow of power to either said first plurality of incandescent lights, to said second plurality of incandescent lights, or to both said first and second pluralities of incandescent lights" should read -- a control switch that is selectively connectable to two or more nodes to adjustably and directly control the flow of power to said first plurality of incandescent lights, said second plurality of incandescent lights, or said first and second pluralities of incandescent lights. --

Column 7,
Line 18, "providing a first plurality of incandescent lights" should be deleted.
Line 21, "various light settings" should read -- different light settings. --
Line 24, "a switch selectively, operatively connectable to one or more nodes for selectively controlling the flow of power to either said first plurality of incandescent lights, to said second plurality of incandescent lights, or to both said first and second pluralities of incandescent lights" should read -- providing a control switch that connects two or more nodes for adjustably and directly controlling the flow of power to said first plurality of incandescent lights, said second plurality of incandescent lights, or said first and second pluralities of incandescent lights. --

UNITED STATES PATENT AND TRADEMARK OFFICE

CERTIFICATE OF CORRECTION

PATENT NO. : 6,604,836 B2 
DATED : August 12, 2003
INVENTOR(S) : Vito L. Carlucci and Richard Neil Tobin It is certified that error appears in the above-identified patent and that said Letters Patent is hereby corrected as shown below:

Column 8,
Line 8, "both the first and second pluralities of incandescent lights to illuminate the mirror a third one of the different light settings" should read -- the first and the second plurality of incandescent lights to illuminate the mirror a third one of the different light settings. --

Signed and Sealed this

Sixth Day of July, 2004

JON W. DUDAS
*Acting Director of the United States Patent and Trademark Office*